United States Patent [19]

Byxbe et al.

[11] 4,068,437

[45] Jan. 17, 1978

[54] PANEL ROOF CONSTRUCTION WITH IMPROVED JOINTS

[75] Inventors: Morley Ben Byxbe, Holland; Richard Allan Meckley, Wyoming; William Hunt Porter, West Olive, all of Mich.

[73] Assignee: W. H. Porter, Inc., Holland, Mich.

[21] Appl. No.: 738,747

[22] Filed: Nov. 4, 1976

[51] Int. Cl.[2] ..... E06B 3/54

[52] U.S. Cl. ..... 52/464; 52/82; 52/539

[58] Field of Search ..... 52/463, 464, 461, 82, 52/467, 468, 364, 394, 539, 593

[56] References Cited

U.S. PATENT DOCUMENTS

| | | | |
|---|---|---|---|
| 1,295,538 | 2/1919 | Lovely | 52/417 |
| 1,416,888 | 5/1922 | Schumacher | 52/417 |
| 3,082,848 | 3/1963 | Keller | 52/417 |
| 3,102,612 | 9/1963 | Dunnington | 52/464 |
| 3,282,005 | 11/1966 | Birdwell | 52/364 |
| 3,290,845 | 12/1966 | Snyder | 52/394 |
| 3,791,088 | 2/1974 | Sandow | 52/467 |
| 3,886,699 | 6/1975 | Bergmann | 52/90 |

FOREIGN PATENT DOCUMENTS

| | | | |
|---|---|---|---|
| 1,041,751 | 10/1953 | France | 52/464 |

*Primary Examiner*—John E. Murtagh

*Attorney, Agent, or Firm*—Emrich, Root, O'Keeffe & Lee

[57] ABSTRACT

A roof structure for a building includes a number of panels, preferably of a sandwich construction with a rigid foam core and upper and lower surfaces which may be metal, wood or other material depending upon the use. A first type of joint extends along the fall line of the roof, with the panels being in side-by-side, spaced relation and supported along their ridges by a roof truss extending along this longitudinal joint. A retainer strip extends along the longitudinal joint and is held in sealing relation with the adjacent panels by means of threaded fasteners secured to the truss. A joint transverse of the fall line is formed by a tongue-in-groove construction of the panels which permits an upper panel to lap over a lower panel for better drainage, and also allows for thermal expansion and contraction.

15 Claims, 9 Drawing Figures

PANEL ROOF CONSTRUCTION WITH IMPROVED JOINTS

BACKGROUND AND SUMMARY

The present invention relates to panel roof construction. Typically, the roof panels are of the sandwich construction, including a central layer or core of rigid plastic foam, an outer surface (preferably metal such as aluminum or steel), and an undersurface which may be decorative, if desired. Panels of the sandwich-type construction have been used in building construction, both for roofs and for walls, and they have the advantage that they have good structural and insulating properties while providing reasonable cost. The outer surface of the panels provides the roof membrane, so that there is no need to apply special roofing material.

Panel roofs have in the past, however, suffered from one principal disadvantage—namely, some leakage of water has occurred at the joints. The joints may be waterproof during initial construction, but it will be appreciated that there is substantial expansion and contraction of the individual panels when exposed to weather, and this has a tendency to rupture or break seals which have previously been used for the joints.

The present invention has as a principal object, the provision of a panel roof construction with joints which allow for normal expansion and contraction of the roof panels, yet which maintains a weatherproof joint between adjacent panels. I have realized that there are two different types of joints in a panel roof construction, and each presents its own problems in effecting a long-lasting seal. One type of joint runs along the fall line, and I refer to this as a "longitudinal" joint. The second type of joint extends transverse of the fall line, and I refer to this as a "transverse" joint. Briefly, according to the present invention, the longitudinal joints between adjacent panels are placed to coincide with the placement of roof trusses. Preferably, the roof trusses are made by joining two C-shaped channel members to form a single beam with a longitudinal slot extending along the longitudinal roof joint. A generally T-shaped metal extrusion (called a retainer strip or covering extrusion) is placed along the longitudinal joint with the arms of the "T" shape overlapping the edges of adjacent panels, and with the base of the T providing a stiffener element for the extrusion and extending into the joint between the panels.

Butyl mastic tape caulk or other sealing means is provided on the outer extremities of the arms of the T, the lower portion of these tapes being provided with a release strip for protection until they are applied. When the release strip is removed, and the extrusion assembled to the joint, it is held in place by means of threaded fasteners extending between the panels, the edges of which are spaced, and received in the longitudinal slot of the truss. Thus, this extrusion acts both to seal the longitudinal joint and to retain the panels in place. This type of joint allows the top skin of the roof panels to bow as it heats in the sun, while maintaining a seal along the longitudinal joints.

The transverse joint is provided by a tongue-in-groove construction of the panels. The upper edge of the lower panel is reduced in depth to provide the tongue. The groove extends along the lower edge of an upper panel, transverse to the fall line, and it is formed by extending the upper and lower skin materials beyond the foam core, and turning them back on one another. A narrow strip of resilient plastic foam is secured to the lower surface of the upper skin material forming the groove. This flexible foam strip is thus interposed between the overlapped outer metal surfaces, thereby forming a shingled or lapped construction, but with the outer skin material of the upper panel being spaced away from the outer skin material of the lower panel. This spacing breaks what would otherwise form a capillary between the two panels for water seepage. Further, it provides an area for effecting a caulk seal, and still further, the flexible strip itself forms a seal. The shingled relation of the outer skin is very important to achieve good drainage from the start. A Fiberglas batt may be inserted in the groove prior to assembly for a still more effective seal.

If conditions permit the transverse joint to be formed at the manufacturer's location, rivets may be used to secure the skin extensions of the upper panel to the tongue of a lower panel, in which case it is not necessary to caulk the lapped exterior seal.

The present invention thus provides a panel roof construction which is strong, has good thermal insulating properties and is convenient to assembly, yet which is economical and has long-lasting weatherproof seals along both the transverse and the longitudinal joints.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
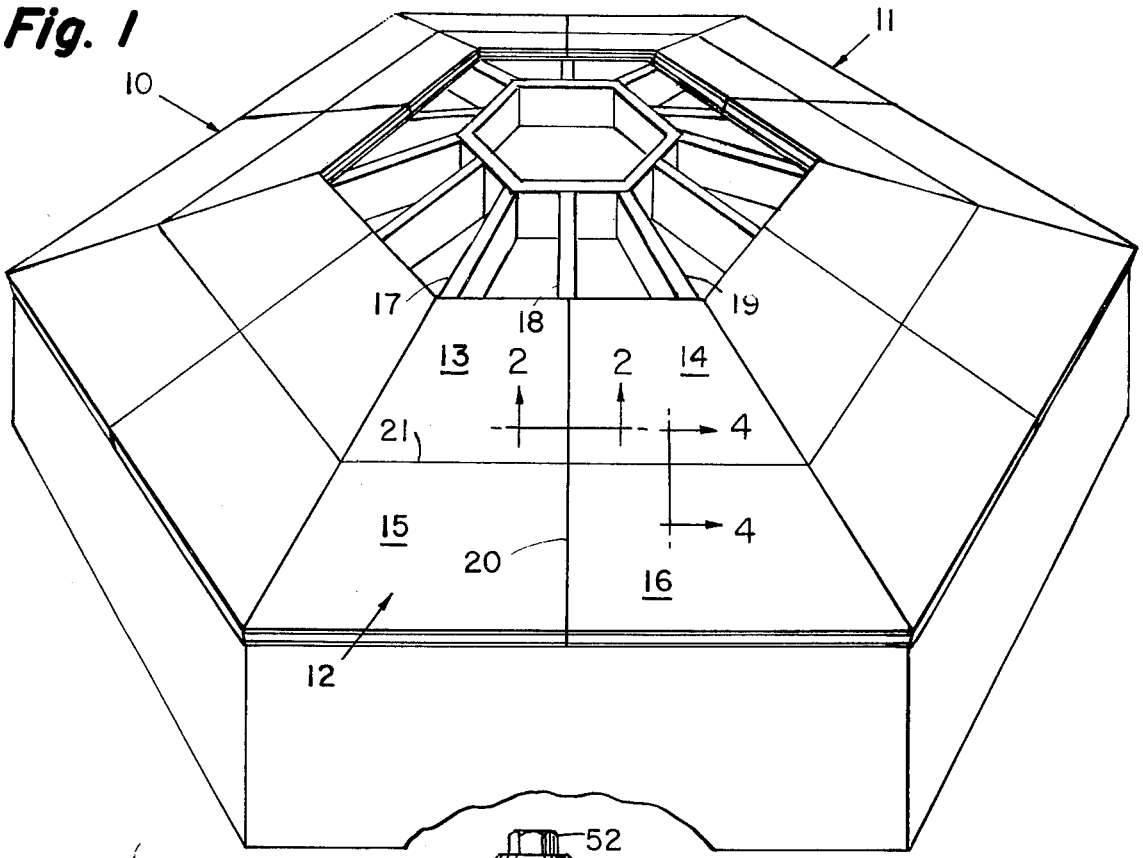
FIG. 1 is an upper perspective view of a hexagonal-shaped building incorporating a panel roof construction according to the present invention.

Referring now to FIG. 1, a building is generally designated by reference numeral 10, and in this illustrated embodiment, the building 10 has a hexagonal shape in plan view. A panel roof construction is generally designated 11, and it includes six wedge-shaped sections, one of which is designated by reference numeral 12. Four individual panels in the roof section 12 are designated respectively 13, 14, 15 and 16.

As will be made clear below, the panel roof construction includes means for forming weatherproof seals at the joints of the panels 13–16 which are supported on roof trusses 17, 18 and 19. Joints extending along the fall line (that is, along the roof trusses in the illustrated embodiment) are referred to as longitudinal joints; and a longitudinal joint is generally designated by reference numeral 20. Joints between adjacent panels which extend transverse of the fall line are referred to as transverse joints; and a transverse joint is generally designated by reference numeral 21 in FIG. 1.

Each of the panels 13–16 is similarly constructed, although the dimensions will obviously vary. A panel roof using rectangular panels or panels of other shape may equally well be employed.

Figure 7:
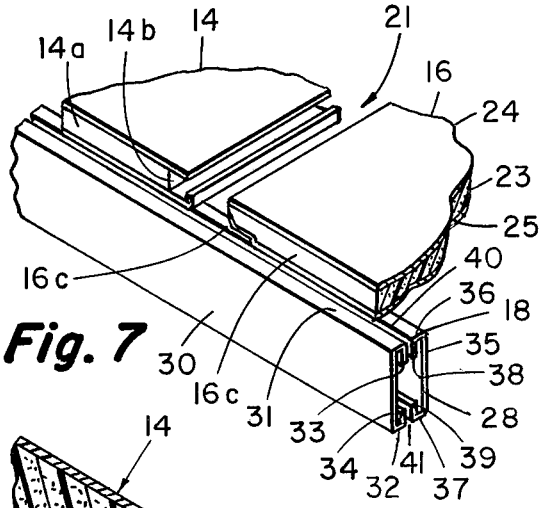
FIG. 7 is a fragmentary upper perspective view illustrating the placement of panels along a roof truss.
Figure 8:
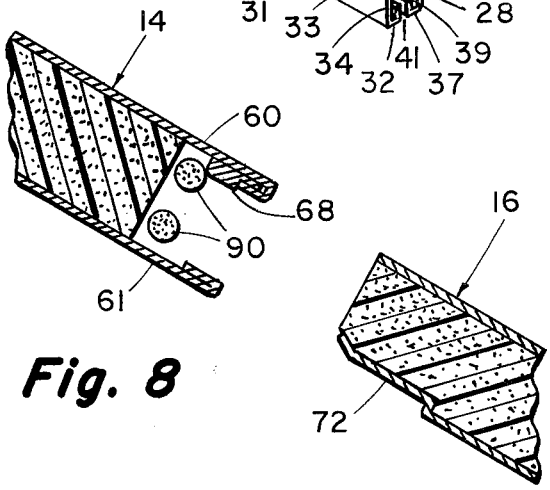
FIG. 8 is a view similar to that taken along the sight line 4—4 of FIG. 1, for a pre-formed transverse joint, with the elements in exploded relation.

Turning now to FIG. 7, each of the panels includes a rigid foam core 23, an outer skin 24, and an under skin 25. The outer skin 24 may be of aluminum or steel, a typical thickness being 0.019 in. The outer skin 24 forms the roof membrane in the final assembly. The undersurface 25 may also be metal, but it may equally well be wood or vinyl for decorative purposes. The central core 23 has structural as well as heat insulating properties.

Turning now to the roof truss 18, it is formed from two C-shaped metal channels 27, 28. The channel member 27 includes a web 30, upper and lower flanges 31, 32 and stiffener members 33, 34. Similarly, the channel member 28 includes a web 35, upper and lower flanges 36, 37, and upper and lower stiffeners 38, 39. The channel members 27, 28 are placed in spaced, opposed relation, and welded together at longitudinally spaced intervals such that the upper stiffener pair 33, 38 form an open channel or slot generally designated 40. A similar slot 41 is formed by the lower stiffener pair 34, 39.

Referring now to the panel 14 for illustrative purposes, its side edges, such as that shown at 14A are cut so that the skins are flush with the core. In assembling the roof panels to the trusses, the edge 14A is placed along the upper slot 40 of the roof truss, as illustrated in FIG. 7. The lower edge of the panel 14 forms a groove, generally designated 14B and described in more detail below. The upper edge of each panel, such as that designated 16C for the panel 16 in FIG. 7 forms a tongue dimensioned to be received in the groove 14B of an upper panel, as will also be described below.

LONGITUDINAL JOINT

Figure 2:
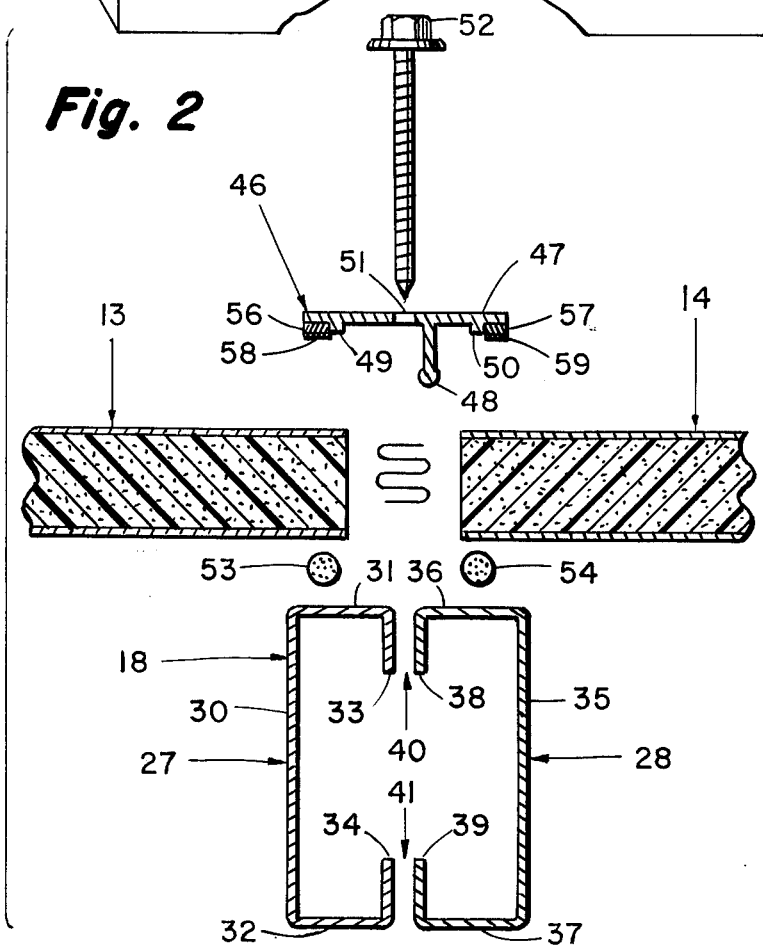
FIG. 2 is a cross sectional view taken along the sight line 2—2 of FIG. 1 showing the elements of a longitudinal joint in exploded relation.
Figure 3:
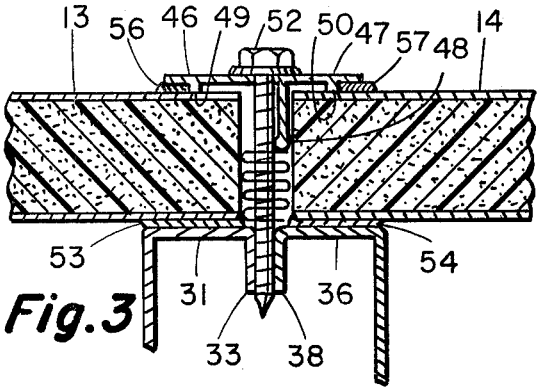
FIG. 3 is a view similar to FIG. 2 with the elements in assembled relation.

Turning now to FIGS. 2 and 3, the flush side edges of laterally adjacent panels 13, 14 are placed in slightly spaced relation to permit expansion and contraction under varying temperature conditions; and they rest respectively on the upper flanges 31, 36 of the roof truss 18. A strip of Fiberglas batt 45 is placed between the flush side edges of the panels. A retainer strip generally designated by reference numeral 46 includes a horizontal web portion 47 and a vertical stiffener member 48 to form a general T-shape in cross section. First and second ribs 49, 50 are formed on the undersurface of the web 47, spaced inwardly from the edges, as illustrated, to provide space for caulk tapes, as will be described.

A number of apertures, one of which is designated 51 in FIG. 2 are spaced along the retainer strip 46 approximately in the center of the horizontal web 47 for receiving self-tapping threaded fasteners 52.

Prior to assembly, beads of mastic 53, 54 are placed respectively along the upper flanges 31, 36 of the roof truss 18. These beads perform a number of functions: (1) they act as adhesive in helping to secure the roof panels to the trusses; (2) they seal the lower surfaces of the roof panels to the truss; and (3) they act as an electrolysis break in the case where the lower surface of the roof panels and the roof trusses are made of dissimilar metals. Strips of compressible sealing material 56, 57 are placed on the underside of the horizontal web 47 and located respectively on the outer sides of the ribs 49, 50.

Preferably, the sealing strips 56, 57 are conventional tape caulk of butyl mastic (preferred because it flows) so that they are self-securing to the retainer strip 46. Release strips 58, 59 may be placed along the bottom surfaces of the sealing strips 56, 57 to preserve the adhesive nature of the butyl mastic until use.

Prior to assembly, the release strips 58, 59 are removed, and the retainer strip 46, which may be formed of extruded aluminum, is placed along the joint, as seen in FIG. 3, with the adhesive sealing strips 56, 57 adhering to the upper skins of the panels 13, 14. The ribs 49, 50 reduce the amount of surface engagement between the outer skins of the roof panels and the cover strip 46 to thereby facilitate movement of the panels relative to the cover strip during thermal expansion and contraction. Further, these ribs limit the compression of the sealing strips 56, 57 and partially define the space where they are received and held. The stiffener member 48 of the retainer strip 46 compresses the batt material 36 to effect sealing; and the retainer strip is firmly secured to the roof truss by screwing the self-tapping threaded fastener 57 into the slot 40 formed by the C-shaped channels 27, 28.

The longitudinal joint thus formed has been found to provide an effective weather seal while permitting the panels to expand and contract under varying temperatures. Further, the primary sealing elements, namely the sealing strips 56, 57 may be applied by the manufacturer prior to assembly and rendered operative by removing the release strips 58, 59. This has the advantage that the primary seal between the cover strip 46 and the upper skins of the roof panels is not determined by the installers. Still further, in cases where there is differential expansion between the outer skin and the inner skin of the panels, the longitudinal joint of the present invention enables the outer skin to bow as it heats, for example, when the sun beats down on it.

TRANSVERSE JOINT

Figure 4:
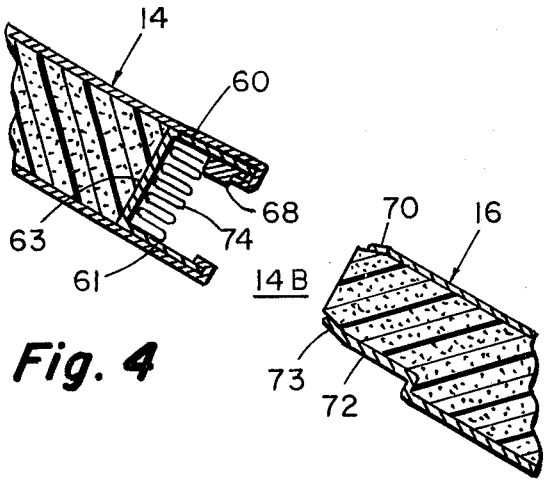
FIG. 4 is a cross sectional view taken along the sight line 4—4 of FIG. 1 showing the elements of a transverse joint in exploded relation.
Figure 5:
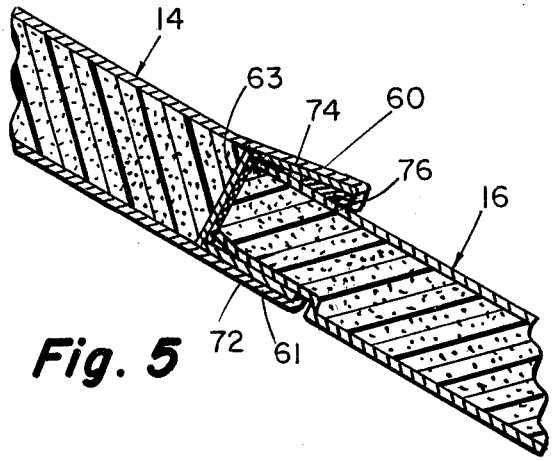
FIG. 5 is a view similar to FIG. 4 with the elements in assembled relation.
Figure 6:
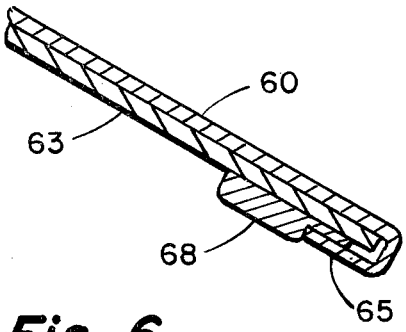
FIG. 6 is a cross sectional close-up view of an extension or lap portion formed by the outer skin of an upper panel in a transverse joint.

Referring now to FIGS. 4–6, there is shown a transverse joint. The lower edge of the upper panel 14 forms the groove 14B by extending the upper skin to form an elongated flange or lap 60. Similarly the lower skin is likewise extended to provide a lower extension or lap 61. A C-shaped channel 63 is inserted into the groove thus formed, and the distal edges of the laps 60, 61 are bent or crimped around the upper and lower flanges of the channel member 63, as at 65 in FIG. 6.

A sealing strip 68 extends lengthwise of the lap 60 and is held beneath the crimped portion 65 on the upper lap 60. The strip 68 is preferably formed of a flexible plastic foam, such as polyvinylchloride. The properties and functions of the sealing strip 68 will be discussed below, but it is considered an important element in forming a transverse joint.

Turning now to the upper edge of the lower panel 16, the upper skin, at the distal end is formed downwardly as at 70 to facilitate its being guided into the groove 14B. The upper portion of the lower skin is reduced as at 72, and similarly inclined at 73 so as to fit into the reduced groove 14B. A Fiberglas batt 74 may be placed in the groove 14B so that when the panels are assembled as seen in FIG. 5, additional sealing against wind is provided.

Referring now particularly to FIG. 5, after the joint is assembled, caulk may be applied as at 76 between the distal edge of the lap 60 and the upper skin of the panel 16. It is preferable that the caulk strip 76 be relatively thin with the concave surfaces as shown, so as to be flexible during expansion and contraction of the panels.

It will be observed from FIG. 5 that the sealing strip 68 not only acts as a seal in itself, but it holds the upper lap 60 spaced away from the upper surface of the lower panel 16. This breaks any capillary between the lap 60 and the lower panel. A lapped joint is highly desirable to provide good drainage during heavy rain, but it has been found that small capillary openings may exist to draw moisture up into the groove from where it may drip onto the lower surface of the ceiling. With the present invention, not only is the capillary broken, but there are seals provided by the caulk 76, the flexible tape 68, the batt 74, and, if desired, another strip of flexible tape may be provided between the bottom lap 61 and the reduced portion 72 of the lower panel 16.

The transverse joint of FIGS. 4–6 has been found to be useful in cases where the panels are assembled on sight. Where it is possible to assemble two panels together at the manufacturing location, the joint illustrated in FIG. 9 may be used. The lower edge of the upper panel 14 is similar to that already described except that the C-channel member need not be incorporated, and a pair of mastic beads 90 may be used in place of the Fiberglas batt 74. Otherwise, however, the groove 14B remains generally the same.

The upper edge of the lower panel 16 is likewise the same as that previously described except that the upper surface need not be turned downwardly at its distal edge, as we done at 70 in FIG. 4.

Figure 9:
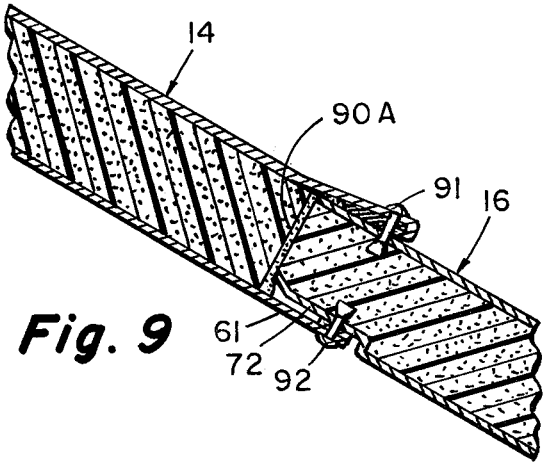
FIG. 9 is a view similar to FIG. 8 with the elements in assembled relation.

When the two panels are assembled as shown in FIG. 9, rivets 91 are used to secure the metal lap 60 to the top surface of the panel 16; and similarly, rivets 92 are used to secure the lower lap 61 of the upper panel to the reduced portion 72 of the undersurface of the lower panel 16. The mastic 90 forms a seal as at 90A in FIG. 9 adjacent the abutting edges of the two panels.

Having thus described in detail a preferred embodiment of the invention, persons skilled in the art will be able to modify certain of the structure which has been illustrated and substitute equivalent materials or elements for those disclosed while continuing to practice the principle of the invention; and it is, therefore, intended that all such modifictions and substitutions be covered as they are embraced within the spririt and scope of the appended claims.

We claim:

1. In a panel roof construction wherein each panel of said roof includes a sandwich type construction having a center insulating core, an outer skin and an under skin, said panels being supported on roof trusses to define longitudinal joints and transverse joints, the improvement comprising: said roof trusses defining an elongated slot extending along said longitudinal joints, the longitudinal edges of said panels being flush, each longitudinal joint including a cover strip extending therealong and having a general T-shape including an upper web straddling the adjacent edges of two panels and a stiffening member adapted to extend into the space between adjacent panels, the lower surface of said web defining a rib adjacent each edge thereof for spacing said web from said roof panels, first and second sealing strips for sealing the sides of said web respectively to adjacent panels, and threaded fastener means for securing said cover strip by threading into said slot of said roof truss at locations spaced along said longitudinal joint; and said transverse joints including a groove at the lower edge of each panel formed by extending the outer and under skins thereof to form upper and lower laps, a strip of flexible sealing material secured to the under surface of said upper lap, the upper edge of lower panels being sized to be received into the groove of an upper panel, said flexible sealing strip acting as a seal in itself and spacing the lap of an upper panel above the outer surface of a lower panel or break the capillary therebetween.

2. The system of claim 1 wherein said roof trusses are formed by two C-shaped channel members with upper and lower stiffener flanges arranged in opposing relation and welded at longitudinal locations so that adjacent stiffener flanges define said elongated slot.

3. The apparatus of claim 2 wherein each of said longitudinal joints further comprises batt material between the flush edges of adjacent panels extending along said trusses.

4. The apparatus of claim 3 wherein each of said longitudinal joints further comprises mastic beads between the lower surfaces of adjacent roof panels and the upper flanges of the associated C-shaped channel members forming said roof truss.

5. The apparatus of claim 1 wherein said cover strip comprises an aluminum extrusion and said web, said ribs and said stiffener are integral elements of said extrusion.

6. The apparatus of claim 1 wherein said first and second sealing strips comprise a strip of butyl mastic secured to the underside of said cover strip adjacent the respective edges thereof and extending therealong, and a release strip for each sealing strip, whereby when said release strips are removed, said cover strip may be placed on adjacent panels and said sealing strips will adhesively engage the upper surfaces of adjacent panels.

7. The apparatus of claim 1 wherein said fastener is a self-tapping screw.

8. The apparatus of claim 1 wherein the upper and lower skin elements of said panels are metal, said groove being formed by extensions thereof and further including a C-shaped element located within said laps, the distal ends of said lapped edges being crimped over the upper and lower flanges of said C-shaped element, said sealing strip being a strip of flexible plastic foam material crimped beneath the upper lap and spaced inwardly of the distal edge thereof to force said upper lap away from the upper surface of the next lower panel.

9. The apparatus of claim 8 further comprising a strip of caulk sealing the distal edge of the upper lap to the next lower panel.

10. The apparatus of claim 9 further comprising batt material in said groove for sealing the abutting edges of the cores of said panels.

11. The apparatus of claim 9 wherein the upper horizontal edges of each of said panels is reduced to be received into an associated groove, and the distal edges of the reduced portion are beveled for guiding said edge into engagement with an associated groove.

12. The apparatus of claim 8 wherein said exterior and lower skin materials of said panels are metal, and further comprising rivet means for securing said upper and lower laps respectively to the upper and lower skins of the next lower panel.

13. In a panel roof construction wherein each panel of said roof includes a sandwich type construction having a center insulating core, an outer skin and an under skin, said panels being supported on roof trusses to define longitudinal joints and transverse joints, apparatus for providing an improved transverse joint comprising: first and second extensions of the skins of said panels adjacent the lower edge thereof to form upper and lower laps providing a groove; a C-shaped metal channel in said groove, the distal edges of said upper and lower laps being folded about said C-shaped channel; a strip of flexible sealing material crimped beneath the distal edge of said upper lap, the upper edge of lower panels being sized to be received into the groove of an upper panel, said flexible sealing strip acting as a seal in itself and spacing the lap of an upper panel above the outer surface of a lower panel to break the capillary therebetween.

14. The apparatus of claim 13 further comprising rivets securing said upper and lower laps of an upper panel respectively to the outer and under skins of a lower panel.

15. An article for retaining roof panels arranged in side-by-side, spaced relation comprising an elongated extrusion of general T cross sectional shape and including a horizontal web adapted to span the space between adjacent panels and overlap the edges thereof, a vertical stiffener adapted to fit into said space, the first and second ribs on the underside extending lengthwise of said web for engaging respectively the top surfaces of adjacent panels, said ribs spaced inwardly of the edges of said web to at least partially define spaces for receiving sealing strips.

* * * * *